US006715160B2

(12) United States Patent
Crye et al.

(10) Patent No.: US 6,715,160 B2
(45) Date of Patent: Apr. 6, 2004

(54) CHEMICAL/BIOLOGICAL SUIT

(75) Inventors: Caleb Clark Crye, Brooklyn, NY (US); Eric Owen Fehlberg, Queens, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 0 days.

(21) Appl. No.: 10/255,569

(22) Filed: Sep. 26, 2002

(65) Prior Publication Data

US 2003/0070211 A1 Apr. 17, 2003

Related U.S. Application Data

(60) Provisional application No. 60/324,889, filed on Sep. 26, 2001.

(51) Int. Cl.[7] ..... A41D 13/00

(52) U.S. Cl. ..... 2/457; 2/69

(58) Field of Search ..... 2/455, 456, 457, 2/458, 2.17, 454, 9, 468, 202, 206, 93, 94, 81, 69; 224/576, 577, 586, 683

(56) References Cited

U.S. PATENT DOCUMENTS

| | | | | | |
|---|---|---|---|---|---|
| 2,794,186 | A | * | 6/1957 | Butters | 2/455 |
| 3,359,567 | A | | 12/1967 | Zemme et al. | |
| 3,516,404 | A | * | 6/1970 | Spross | 2/455 |
| 3,818,507 | A | | 6/1974 | Albrecht | |
| 4,351,066 | A | * | 9/1982 | Pearsall | 2/85 |
| 4,523,703 | A | * | 6/1985 | McKenna | 224/224 |
| 4,683,593 | A | * | 8/1987 | Langley | 2/82 |
| 4,831,664 | A | * | 5/1989 | Suda | 2/81 |
| 4,860,382 | A | | 8/1989 | Markwell | |
| 4,901,370 | A | | 2/1990 | Suda | |
| 5,017,424 | A | | 5/1991 | Farnworth et al. | |
| 5,040,243 | A | * | 8/1991 | Tatsuno | 2/94 |
| 5,097,535 | A | | 3/1992 | Dye et al. | |
| 5,452,476 | A | * | 9/1995 | Jenks | 2/94 |
| 5,564,125 | A | * | 10/1996 | Waldman et al. | 2/94 |
| 5,692,935 | A | * | 12/1997 | Smith | 2/69 |
| 5,850,634 | A | * | 12/1998 | Toombs | 2/93 |
| D414,013 | S | * | 9/1999 | Group | D2/828 |
| 5,991,921 | A | | 11/1999 | Saito | |
| 6,032,285 | A | * | 3/2000 | Densen | 2/69 |
| 6,108,815 | A | * | 8/2000 | Majerfeld | 2/79 |
| 6,360,370 | B1 | * | 3/2002 | Ferreras | 2/69 |

* cited by examiner

*Primary Examiner*—Gary L. Welch
(74) *Attorney, Agent, or Firm*—Stiennon & Stiennon

(57) ABSTRACT

A hazard protection suit has a pants section which extends to waist level. A torso section extends upwardly to an upper margin below the wearer's arm pits, and a stowage flap extends outwardly therefrom, to hang down over the torso section and to enclose, by a resilient cord, the upper section of the suit including the sleeves, a hood, and a face mask. The upper body section is retained in a folded compact condition against the wearer's torso in ordinary wear. When needed, the retention member is released and the wearer's hands are extended through looped sleeve cuffs, and zippers are operated to secure the upper body section around the wearer, making a sealed interior space. The wearer's utility belt and gear pouches may remain in place as they are undisturbed by the donning of the upper body section. The face mask is secured along a face encircling zipper.

12 Claims, 8 Drawing Sheets

CHEMICAL/BIOLOGICAL SUIT

CROSS REFERENCES TO RELATED APPLICATIONS

This application claims the benefit of the filing date of U.S. Provisional Application No. 60/324,889, filed Sep. 26, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to protective clothing in general, and more particularly to a full body suit for protection against chemical and biological warfare agents.

Although the use of chemical and biological agents in the conduct of warfare is prohibited under many international treaties, the striking effectiveness of poison gases and viral or bacteriological infectious agents such as anthrax can make the use of such materials appealing to military forces or to nongovernmental terrorist organizations. These agents work against individual soldiers by inhalation and skin contact. Protection against chemical and biological agents therefore requires the complete shielding of the soldier's body as well as filtering of the air which the soldier breathes.

This complete shielding is achieved by a full body protective garment which extends over the soldier's legs, torso, chest and arms. Together with a hood, gloves, and boots, with airtight seals therebetween, an isolated enclosed environment is created for the soldier. Although the full body suit prevents the entry of pathogens, it does this at the cost of reduced air circulation, the attendant heat retention, and some reduction in mobility. Although advances in textiles and engineered materials have improved the comfort levels of this type of suit, the very nature of the total enclosure makes it cumbersome and limiting on optimal performance.

With current technology soldiers deployed in regions where chemical or biological warfare is a possibility have two options: carry out all activities outfitted in the full body suit or carry out activities without chemical biological protection while maintaining the protective garment in the vicinity for rapid donning. The first option comes at a price of significantly reduced performance, while the second option runs the risk that the chemical or biological attack will strike too suddenly for the soldier to reach the safety of the full body suit.

What is needed is a chemical or biological hazard protection suit which can be worn in a fashion which only marginally impacts performance and which can rapidly be converted to full chemical/biological protection.

SUMMARY OF THE INVENTION

The chemical or biological hazard protection suit of this invention strikes a balance between soldier performance and readiness by being capable of being worn in a partially stowed condition which leaves the soldier's upper body uncovered. The hazard protection suit has a pants section with two pants legs which extend to waist level and a torso section which extends from waist level to a position below the wearer's arm pits. A stowage flap extends outwardly from the upper margin on the torso section. The stowage flap has a lower outer margin, and hangs down on the outside of the torso section. The stowage flap outer margin has a retention member which encircles the wearer at a position above the waist and which holds the stowage flap engaged with the torso section. An upper body section of the suit is stowed within the stowage flap, retained in a folded compact condition against the wearer's torso above the waist and below the arm pits. The upper body section is comprised of sleeves joined by front and rear sections, a hood, and a face mask. When stowed behind the stowage flap the upper body section provides minimal interference with the activities of the wearer. At the onset of hostilities or on notice of a chemical/biological threat, the retention member, which may be an elastic cord or a draw cord, is released and the upper body section is deployed from behind the stowage flap. The wearer places his hands through cuffs at the ends of sleeves and then operates zippers running the lengths of the sleeves to the hood and face mask to a rapidly achieve full enclosure. The cuffs may have connected gloves associated therewith, or gloves may be attached later. The wearer's utility belt and gear pouches may remain in place as they are undisturbed by the donning of the upper body section.

It is an object of the present invention to provide a hazard protection suit which may be worn in a partially deployed condition.

It is another object of the present invention to provide a hazard protection suit which may be rapidly donned from a partially deployed condition.

It is also an object of the present invention to provide a hazard protection suit having an integral respirator mask.

Further objects, features and advantages of the invention will be apparent from the following detailed description when taken in conjunction with the accompanying drawings.

DESCRIPTION OF THE PREFERRED EMBODIMENTS

Figure 1:
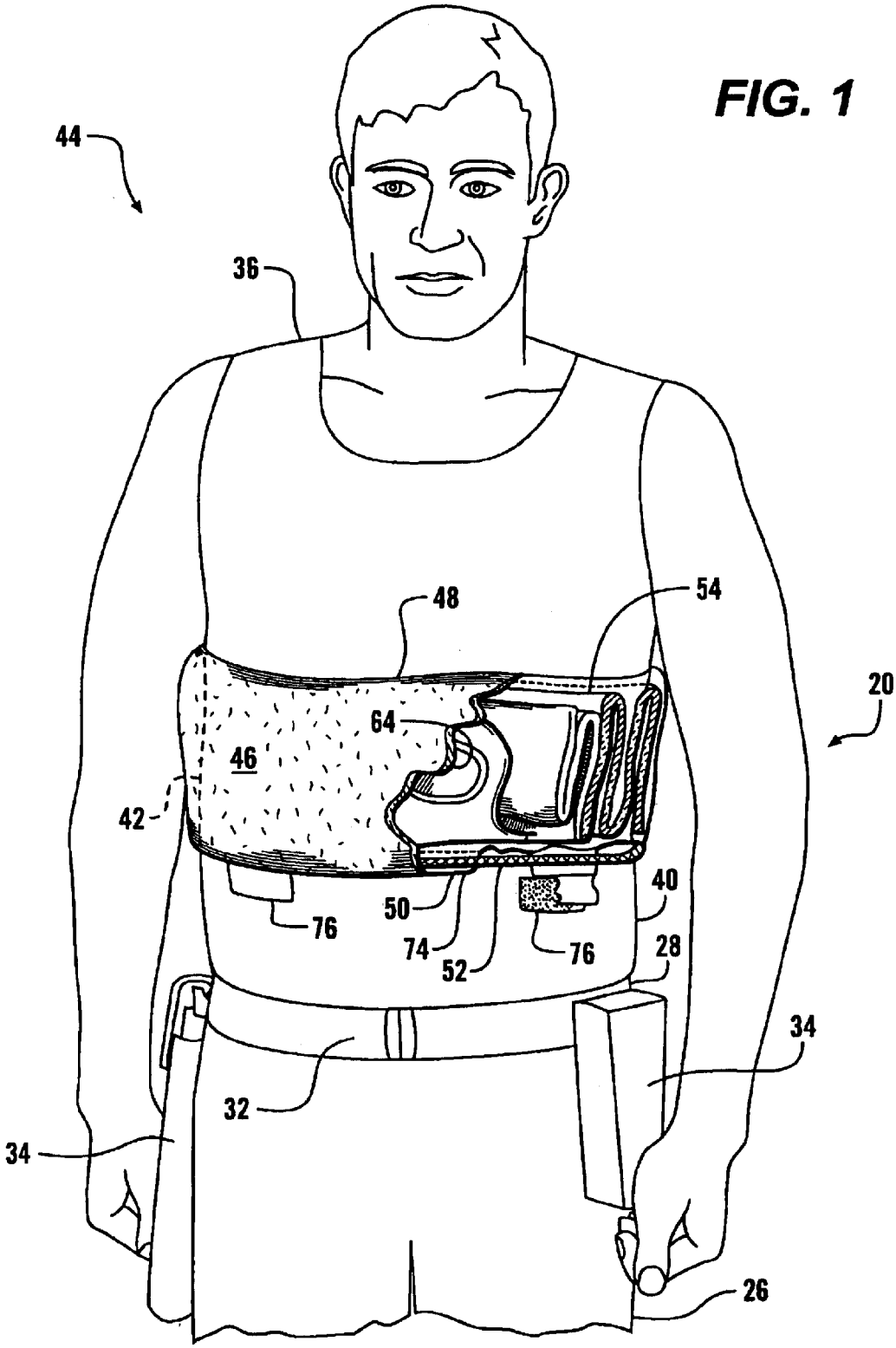
FIG. 1 is a front view of the chemical/biological hazard protection suit of this invention worn by a soldier in its partially stowed condition.

Referring more particularly to FIGS. 1–14, wherein like numbers refer to similar parts, a chemical/biological hazard protection suit 20 is shown in FIG. 1. The suit 20 may be fabricated of conventional chemical/biological hazard suit material such as selectively permeable membrane material, and may incorporate conventional features of such suits which promote exchange of water vapor, and cooling air circulation. The suit 20 is configured to permit it to be worn in a partially stowed condition as shown in FIG. 1 and rapidly fully donned as shown in FIGS. 2–5 when the need arises.

As shown in FIG. 1, the suit 20 has a lower body section 22 comprised of two pants legs 24 forming part of the pants section 26 which extends to waist level 28. The suit 20 will be worn in conjunction with boots 30 which are sealed to the pants legs 24 in a conventional fashion. The suit 20 has an exterior belt 32 which supports it in the partially deployed condition. Various gear pouches 34, sidearms or other waist mounted accessories may be mounted to the belt 32, or to another utility belt as needed by a particular soldier. The suit 20 will be worn with an undergarment 36 such as a T-shirt or tank top.

A tubular torso section 40 extends upwardly from the lower body section 22 and terminates in an upper margin 48 which encircles the torso 42 of the wearer 44. A flexible stowage flap 46 extends from the torso section upper margin 48 and encircles the wearer 44. The stowage flap 46 hangs downwardly from the upper margin 48 a distance of approximately 6 to 9 inches. The stowage flap 46 terminates in an outer margin 50 which is provided with at least one retention member 52 which serves to retain the outer margin of the stowage flap engaged against the torso section around the wearer's torso 42 above the waist 28. The stowage flap 46 is of flexible material and bulges outwardly from the torso section 40. The stowage flap 46 may be fabricated of the same material as the suit itself, or, because the stowage flap is not required to form a barrier against biological or chemical hazards, may be formed of a more stretchy, resilient material such as duPont Lycra® stretch fiber fabrics such as spandex. When the suit 20 is fully deployed, the stowage flap will be worn against the wearer's chest.

Figure 2:
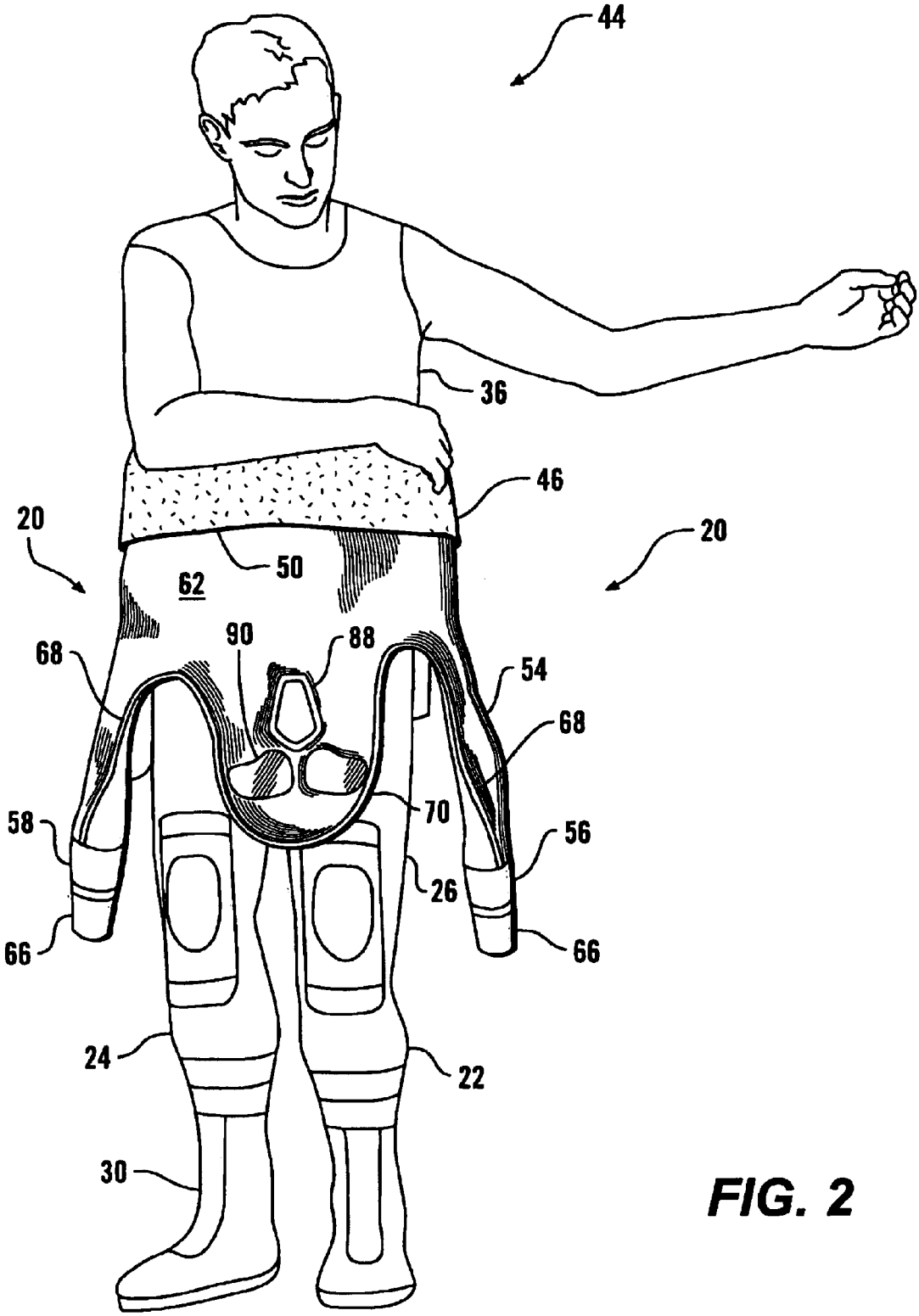
FIG. 2 is a front view of the hazard protection suit of FIG. 1 with the upper body section of the suit deployed from its stowed position prior to being donned by the soldier.

An upper body section 54 of the suit 20 is retained between the stowage flap 46 and the torso section 40 when the suit is worn in its partially stowed condition as shown in FIG. 1. As best shown in FIG. 2, the upper body section 54 has a left sleeve 56 and a right sleeve 58 which are connected by a rear section 60 and a front section 62. The upper body section 54 extends from the torso section upper margin 48, and, being fabricated of the thin sheet material, is readily folded and compressed into the narrow storage compartment 64 defined between the stowage flap 46 and the torso section 40 of the suit 20.

Figure 5:
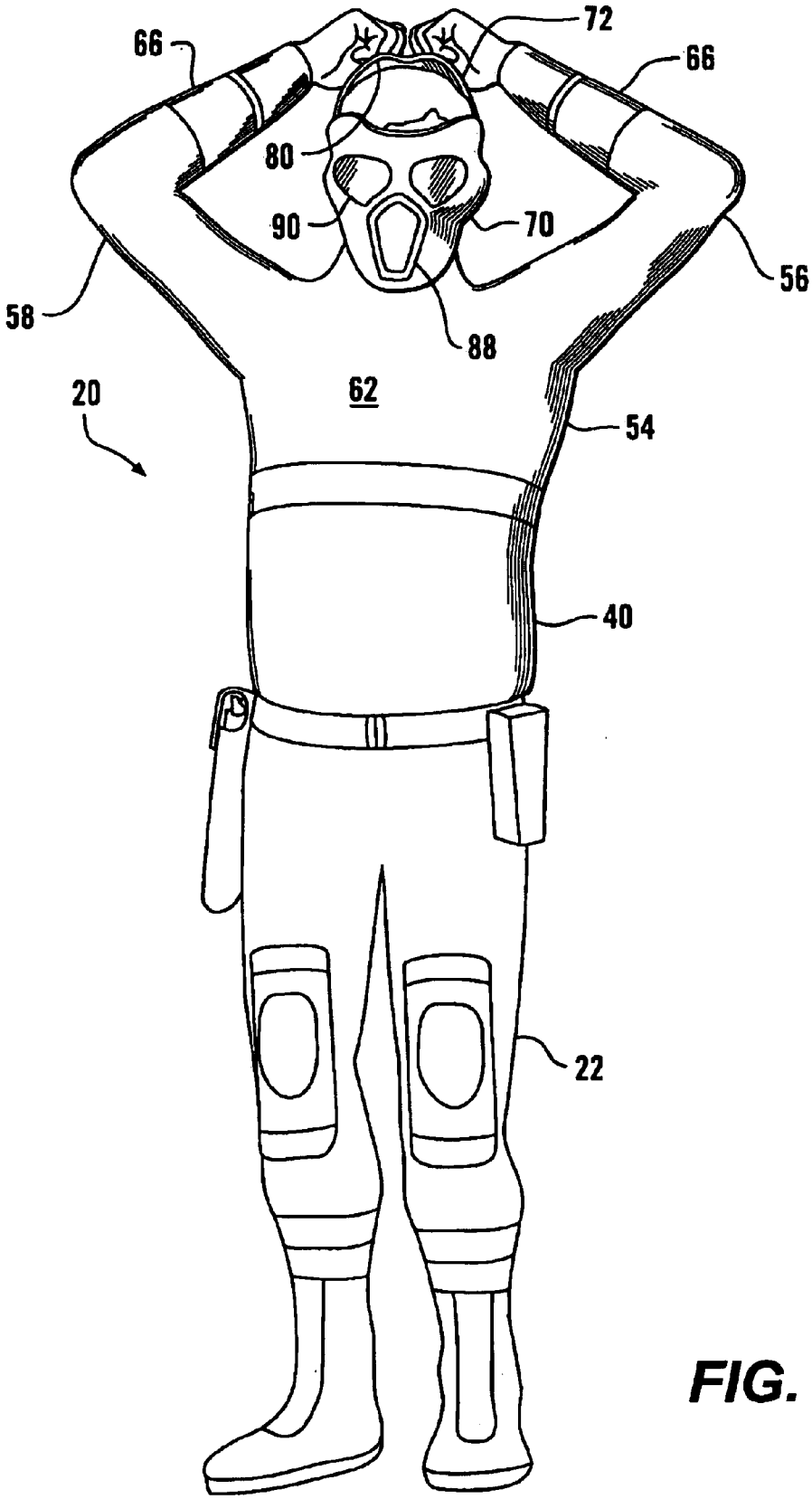
FIG. 5 is a front view of the hazard protection suit of FIG. 1 with the hood and respirator mask being sealed about the soldier's head.
Figure 7:
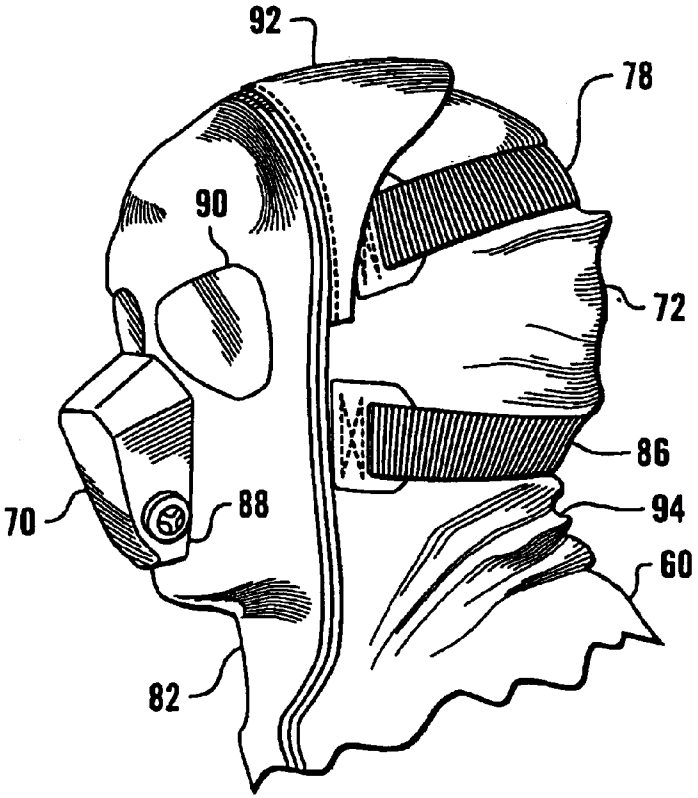
FIG. 7 is a side view of the hazard protection suit of FIG. 1, with the respirator mask and sealed to the hood and the visor folded out of use.
Figure 6:
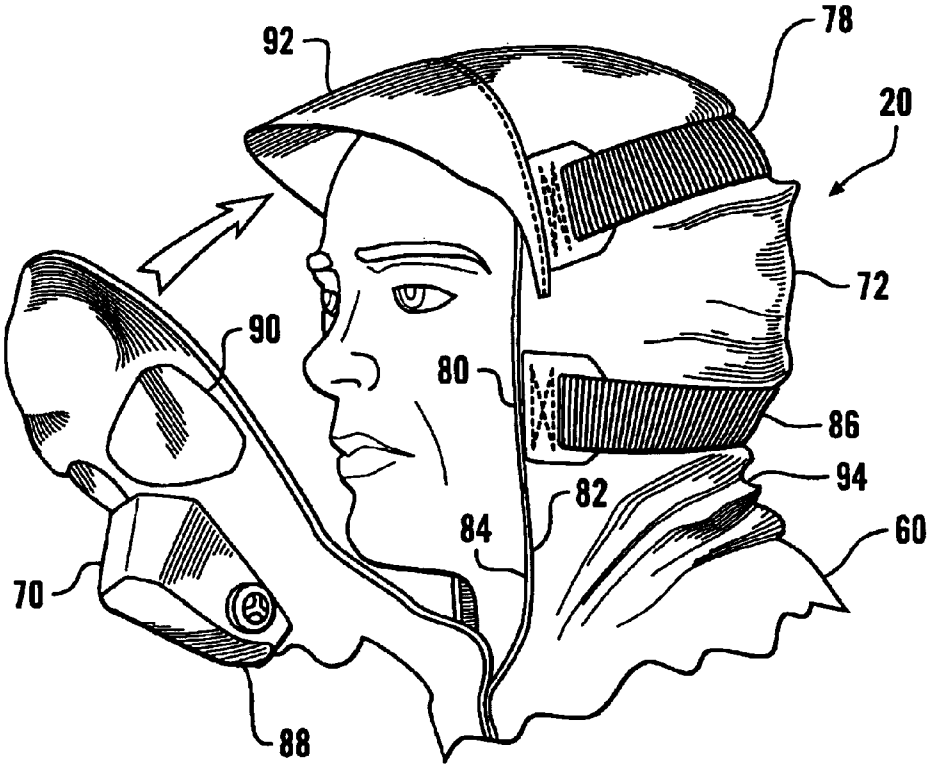
FIG. 6 is a side view of the hazard protection suit of FIG. 1 with the respirator mask prior to being sealed to the hood, with the visor deployed.

Each sleeve 56, 58, has a tubular cuff 66 which is a closed loop of material from which the sleeve extends as an expanded flap of material which joins the rear section 60 and front section 62. A sleeve zipper 68 extends from the cuff 66, preferably at the front or top of each sleeve and runs along the length of the sleeve towards the center of the suit. The front section 62 is preferably provided with a respirator mask 70 as shown in FIGS. 5–7. The rear section 60 is provided with a hood 72. The zippers are conventional sealing zippers which form an air-tight seal, for example by having a rearward gasket strip.

The entire upper body section 54 is retained in the storage compartment 64, and the retention member 52 serves to hold the stowage flap 46 over the folded upper body section 54. The retention member 52 may be a single elastic cord which encircles the torso 42 of the wearer within a hem 74. To further secure the stowage flap 46, as well as to relieve tension under the arms of the wearer, two front fasteners 76 extend between the stowage flap 46 and the front of the torso section 40. The front fasteners 76 may be strips of hook and loop fastener, and are positioned spaced from one another immediately forward of the arms.

As shown in make FIG. 1, when a soldier is deployed in circumstances presenting the possibility of encountering chemical or biological warfare agents, the suit 20 may be donned in a safe location prior to the detection of an actual hazard. The soldier can then go about his ordinary activities. Although the soldier must contend with the additional weight of the suit 20, because his arms, head, and upper body are not enclosed within the suit, normal respiration and cooling can take place. Once an imminent hazard has been detected, the wearer 44 must immediately seek protection. The suit 20 allows the wearer 44 to fully isolate himself from airborne hazards in an extremely short period of time. The donning of the suit 20 is illustrated in FIGS. 2–5.

Figure 3:
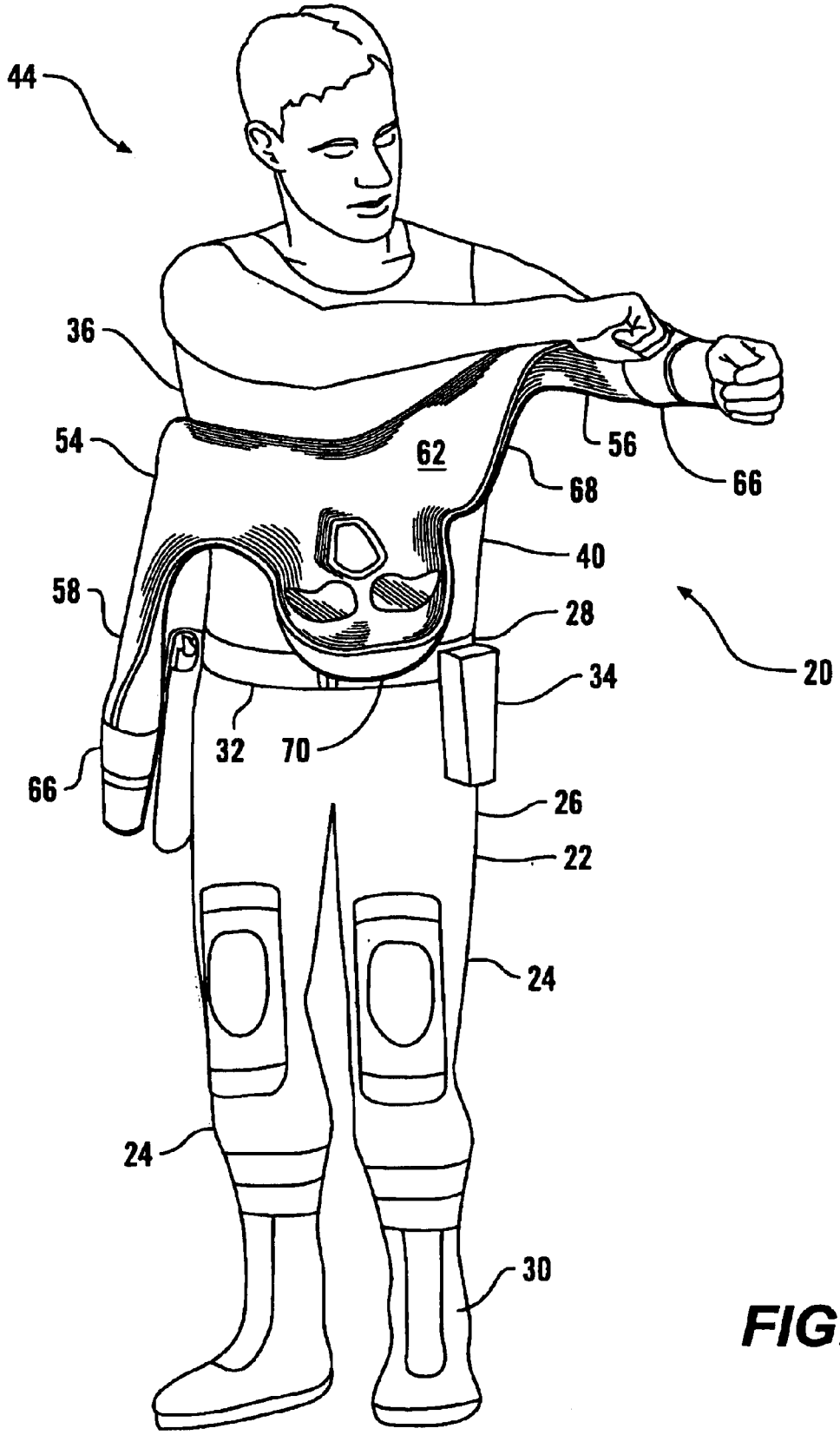
FIG. 3 is a front view of the hazard protection suit of FIG. 1 with the upper body section partially donned, showing the operation of a zipper by the soldier.
Figure 4:
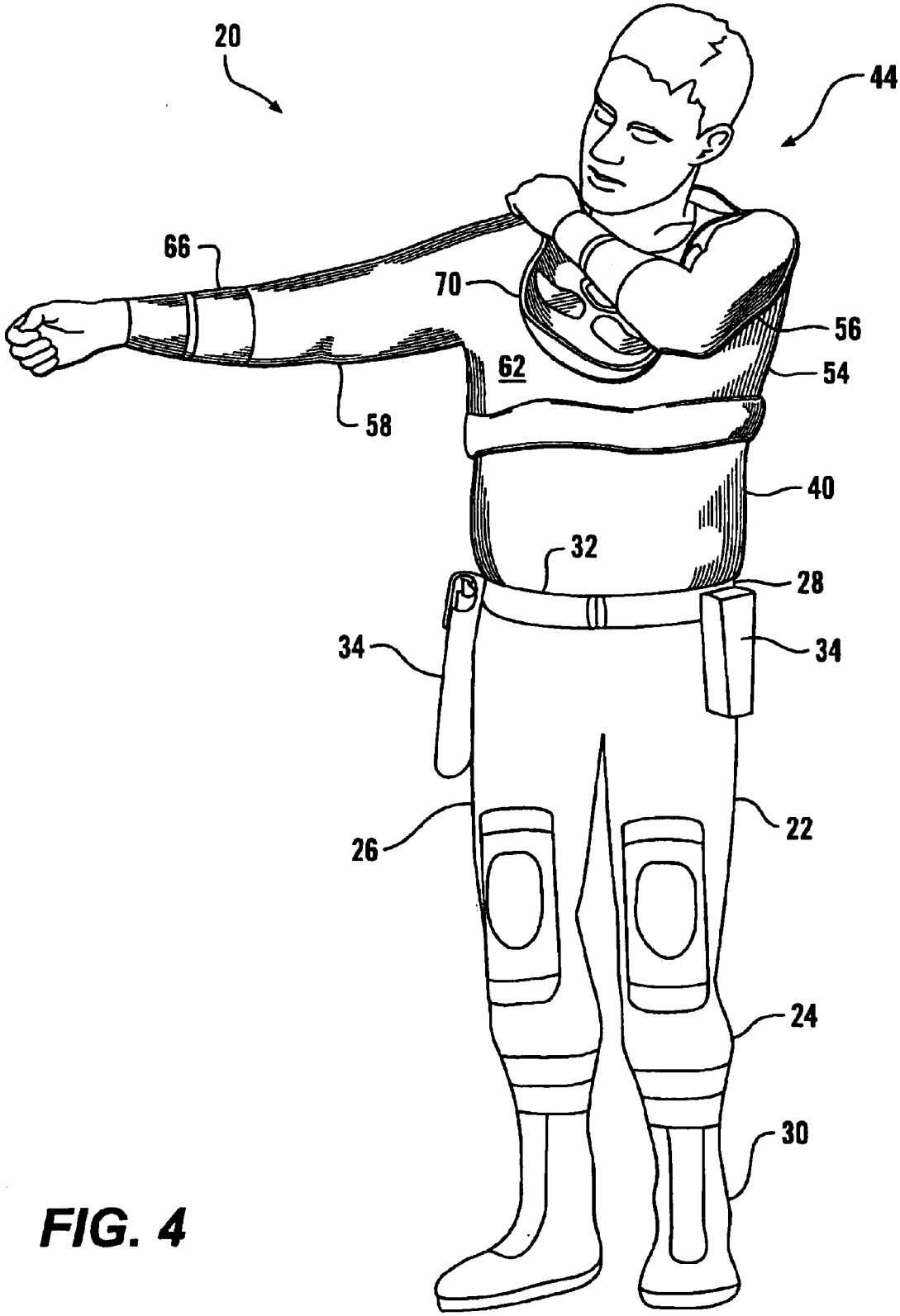
FIG. 4 is a front view of the hazard protection suit of FIG. 1 showing both sleeves of the upper body section donned by the soldier.

First the wearer grips the stowage flap 46 at the outer margin 50 thereof and pulls upwardly to separate the fasteners 76 and bring the outer margin of the stowage flap upwardly above the folded upper body section 54. Once released from the restraint of the stowage flap 46, the upper body section 54 deploys downwardly as shown in FIG. 2. The wearer 44 then inserts his hands through the cuffs 66, as shown in FIG. 3. Using the opposite hand, the zipper 68 is pulled from the cuff to the center of the suit as shown in FIGS. 3 and 4. The hood 72 is then brought over the back of the head as shown in FIG. 5, and the respirator mask 70 is secured to the hood 72 as shown in FIG. 7. It will be noted, that, when fully donned, the stowage flap 46 will be on the interior of the suit 20, with the outer margin 50 extending upwardly from the upper margin 48 of the torso section. The elastic retention member then helps to keep the stowage flap 46 adjacent the wearer, and thereby avoids uncomfortable contact with a free flap inside the garment.

The operation of the hood 72 and the respirator mask 70 is shown in FIGS. 6 and 7. The hood has an upper head strap 78 which is fixed to one side of the hood adjacent a hood opening 80 along which a sealing zipper extends. The zipper 82 may be an extension of the sleeve zippers 68 or may be an independent zipper. The upper head strap 78 is preferably formed of elastic material and extends around the hood to the opposite side of the hood opening 80 where it is secured adjacent the hood opening along the periphery 84 of the hood. One of the ends of the upper head strap 78 may extend through a buckle, not shown, to allow size adjustment of the hood, with or without the attached respirator mask 70. A lower head strap 86, similar to the upper head strap 78, is positioned lower down on the hood 72. When the zipper 82 is sealed, the mask 70 is firmly pulled against the face, sealing the nose and mouth into a respirator 88 which is formed as part of the respirator mask 70. At the same time, the wearer's eyes are brought into engagement with close fitting goggles 90.

A flexible visor 92, such as those commonly available on consumer technical jackets and shells, is secured along an upper seam to the top of the hood 72. As shown in FIG. 6, the visor 92 may be deployed to shield the eyes of the wearer, or, alternatively, it may be folded back over the hood when not needed or to allow a helmet or other accessory to be worn over the hood. The hood 72 is provided with a large amount of baffling 94 around the neck of the wearer to allow the wearer's head to freely turn without restriction. The baffling 94 is simply loose material which forms flaps or folds which allow the turning of the head without restriction.

The suit 20 thus forms a protective enclosed environment which prohibits the intrusion of pathogens such as anthrax and hazardous chemicals such as mustard gas or nerve gas.

It should be noted that, although two zippers 68 extending along the sleeves have been discussed and illustrated above, other sealing arrangements may be employed. For example, a single zipper may extend along the front of each sleeve to meet a central vertically extending zipper on the front section of the upper body section. The three zippers may then come together at a common point.

Figure 8:
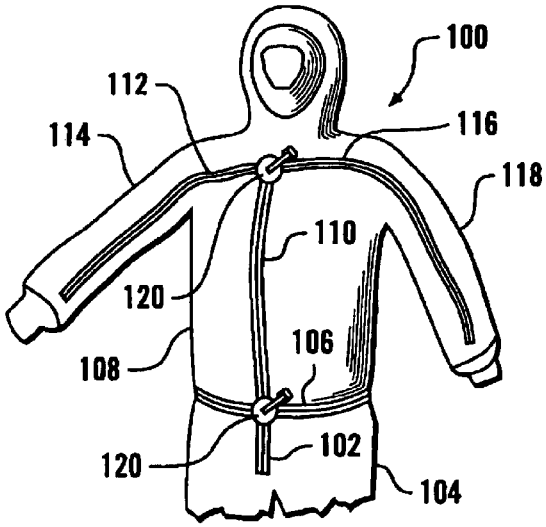
FIG. 8 is a fragmentary front elevational view of an alternative embodiment hazard protection suit of this invention having multiple zippers which meet at a releasable seal.
Figure 9:
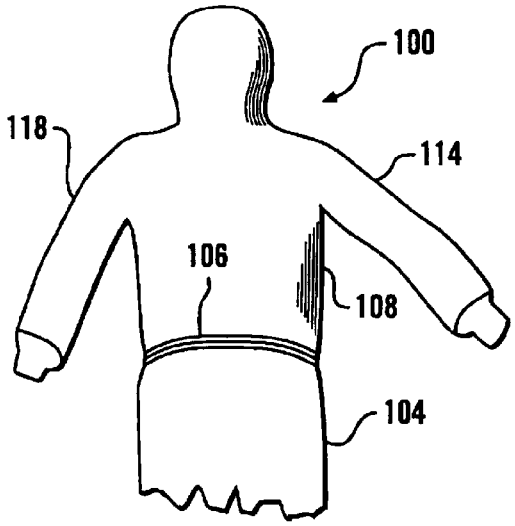
FIG. 9 is a fragmentary rear elevational view of the suit of FIG. 8.

Alternative zipper placement arrangements are illustrated in FIGS. 8–11. The hazard protection suit 100, as shown in FIGS. 8 and 9, has a first zipper 102 which seals the front of the pants 104; a second zipper 106 which connects the pants 104 to the torso section 108 of the suit; a fourth zipper 110 which extends upwardly along the front of the suit; a fifth zipper 112 which extends along the right sleeve 114 to the fourth zipper; and a third zipper 116 which extends from the fourth zipper along the left sleeve 118. Where multiple zippers come together there will be a gap or opening between the zippers where they meet. To prevent air infiltration through these openings, they may be covered with a zipper seal 120.

Figure 13:
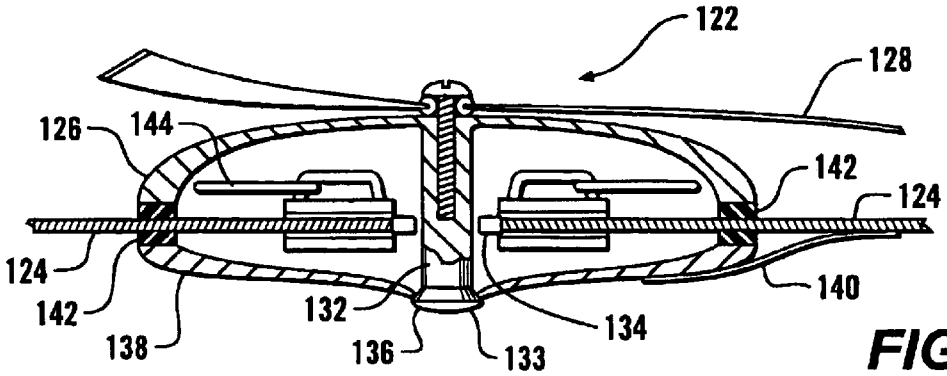
FIG. 13 is a cross-sectional view of the multiple zipper seal of FIG. 12, taken along section line 13—13.
Figure 12:
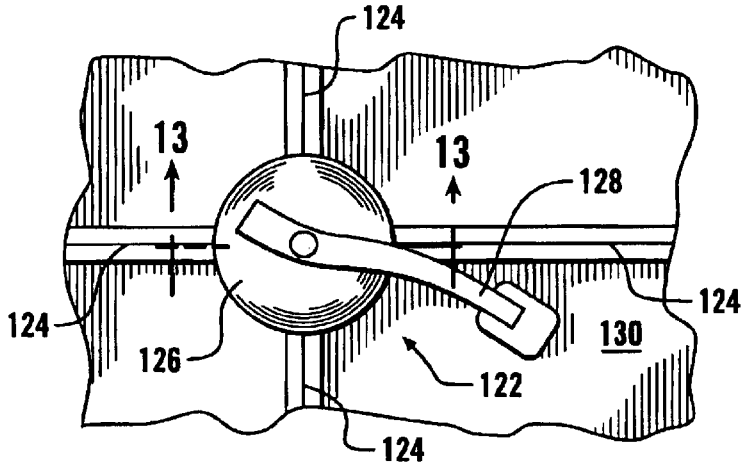
FIG. 12 is a fragmentary front elevational view of a multiple zipper seal for a chemical biological hazard protection suit.
Figure 14:
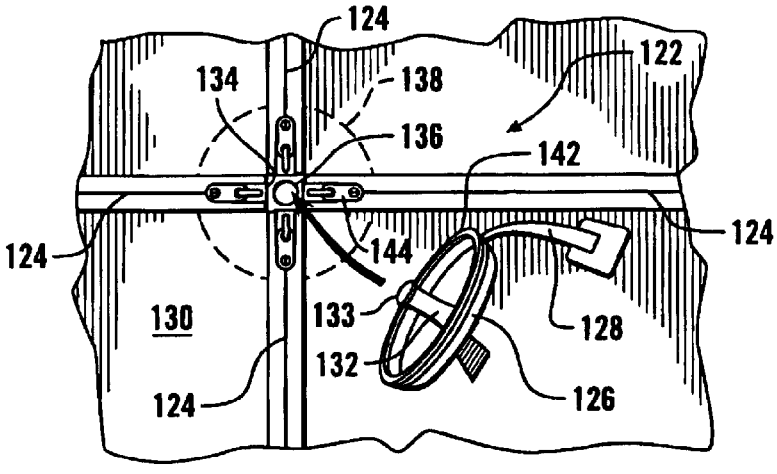
FIG. 14 is a fragmentary front elevational view of the multiple zipper seal of FIG. 12 with the sealed and an open configuration.

An exemplary zipper seal 122 is shown in FIGS. 12–14. Zipper seals of this type may be configured to seal the locations where two, three, or more zippers come together. The zipper seal 122 is illustrative of the meeting of four zippers 124. The zipper seal 122 has a stiff cover 126, formed of metal or plastic which is generally convex and in the shape of an inverted bowl. The cover 126 is retained in connection with the suit at all times by a flexible outer tether 128 which is fastened to the suit fabric 130 at a position spaced from the zippers. The cover 126 has a central stalk 132 which protrudes inwardly, as shown in FIG. 13, to penetrate the opening 134 between the zippers 124. The cover stalk 132 has an protruding nubbin 133 at its furthest end which engages with a resilient pocket 136 formed in a mating plastic base 138 secured on the interior of the suit by a flexible inner tether 140. The inner tether 140 may be a loose tether, or the tether can be a plastic strip which serves to keep the base 138 in the general vicinity of the zipper opening 134 for convenient attachment to the cover 126. The base 138 is a shallow concave dish with a circular perimeter which matches the perimeter of the cover 126.

Rubber gaskets 142, having generally a ring shape, are fixed to the perimeters of the base 138 and the cover 126. Once all the zipper pulls 144 are in their sealed positions, the wearer brings the base 138 into position behind the opening 134 by manipulating the base through the fabric of the suit, and the cover 126 is made to overlap the base 138 and the cover stalk 132 nubbin 133 is snapped into engagement with the base pocket 136. The rubber gaskets 142 thus press against each other through the suit fabric to form an airtight seal.

Figure 10:
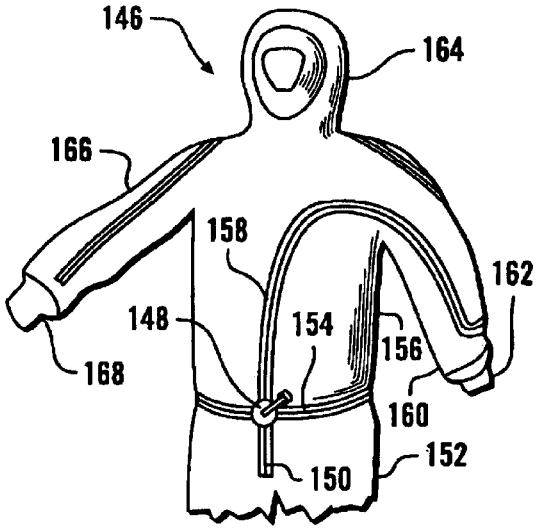
FIG. 10 is a fragmentary front elevational view of an alternative embodiment hazard protection suit of this invention having an alternative zipper arrangement.
Figure 11:
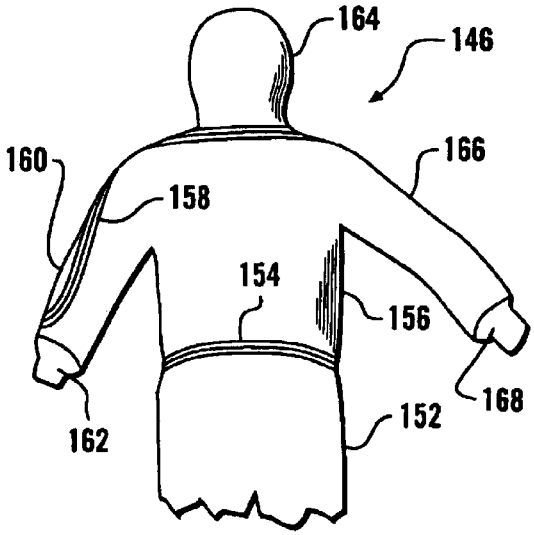
FIG. 11 is a fragmentary rear elevational view of the hazard protection suit of FIG. 10.

Another alternative embodiment chemical/biological hazard protection suit 146 is shown in FIGS. 10–11. The suit 146 employs a single zipper seal 148, similar to the one shown in FIGS. 12–14. The suit 146 has a first zipper 150 sealing the front of the pants 152; a second zipper 154 at waist level which seals the pants to the torso section 156; and a third zipper 158 which extends upwardly along the front center of the suit, turns to extend along the front of the left sleeve 160, crosses to the rear of the sleeve adjacent the cuff 162, then travels behind the hood 164 to extend along the right sleeve 166 and terminate near to the right sleeve cuff 168. The three zippers 150, 154, 158 meet at the zipper seal 148.

Both the suits 100, 146 have the storage compartment of the suit 20, and in the partially stowed condition can be stored within a stowage flap.

It should be noted that, although a resilient cord is discussed above as the retention member for the stowage flap, other structures may be employed, for example: a zipper which encircles a portion of the outer margin of the stowage flap; strips of hook and loop fastener, snaps, a rip cord, a belt with buckle, a laced cord, etc. However, the alternative retention members should be placed on the stowage flap to avoid discomforting contact with the wearer when the stowage flap is in the fully deployed condition. It may be possible to allow the stowage flap to hang down within the fully deployed suit, rather than being elasticly retained in an elevated position.

It is understood that the invention is not limited to the particular construction and arrangement of parts herein illustrated and described, but embraces all such modified forms thereof as come within the scope of the following claims.

We claim:

1. A hazard protection suit which forms a sealed interior space, the suit comprising:

a pants section having two pants legs which extend upwardly to a waist level;

an encircling tubular torso section connected to the pants section, and extending upwardly from the waist level;

a stowage flap extending from an upper margin of the torso section and terminating in an outer margin, the stowage flap having portions which overlie the torso section;

at least one retention member positioned in proximity to the stowage flap outer margin, the retention member retaining the stowage flap outer margin engaged with portions of the torso section below the torso section upper margin; and an upper body section comprised of a left sleeve and a right sleeve connected by a rear section and a front section, the upper body section extending from the torso section upper margin to be retained between the stowage flap and the torso section and held in place about a wearer's body above the waist level, wherein the retention member is releasable to discharge the upper body section from between the stowage flap and the torso section such that the upper body section may assume a deployed position, in which it extends upwardly from the upper margin and the left sleeve and right sleeve fitted over the wearer's arms.

2. The hazard protection suit of claim 1 further comprising:

a left cuff extending from the left sleeve; and a right cuff extending from the right sleeve, wherein each cuff defines a closed loop through which a wearer's hand may extend.

3. The hazard protection suit of claim 1 wherein the retention member comprises an elastic cord encircling the stowage flap outer margin.

4. The hazard protection suit of claim 1 further comprising:

a first fastener positioned on the stowage flap and adjacent the outer margin to releasably engage the torso section at a position frontward of the right sleeve; and a second fastener positioned on the stowage flap and adjacent the outer margin to releasably engage the torso section at a position frontward of the left sleeve and spaced sidewardly from the first fastener.

5. A hazard protection suit comprising:

a pants section having two pants legs which extend upwardly to a waist level;

an encircling tubular torso section extending upwardly from the waist level;

a stowage flap extending from an upper margin of the torso section and terminating in an outer margin, the stowage flap having portions which hang downwardly to overlie the torso section;

at least one retention member positioned in proximity to the stowage flap outer margin, the retention member retaining the stowage flap outer margin engaged with portions of the torso section below the torso section upper margin;

an upper body section comprised of a left sleeve and a right sleeve connected by a rear section and a front section, the upper body section extending from the torso section upper margin to be retained between the stowage flap and the torso section and held in place about a wearer's body above the waist level, wherein the retention member is releasable to discharge the upper body section from between the stowage flap and the torso section such that the upper body section may assume a deployed position, in which it extends upwardly from the upper margin and the left sleeve and right sleeve fitted over the wearer's arms;

a hood extending from the upper body section;

a first zipper extending along the left sleeve; and a second zipper extending along the right sleeve, wherein the first zipper and the second zipper extend to the hood.

6. A hazard protection suit comprising:

a pants section having two pants legs which extend upwardly to a waist level;

an encircling tubular torso section extending upwardly from the waist level;

a stowage flap extending from an upper margin of the torso section and terminating in an outer margin, the stowage flap having portions which hang downwardly to overlie the torso section;

at least one retention member positioned in proximity to the stowage flap outer margin, the retention member retaining the stowage flap outer margin engaged with portions of the torso section below the torso section upper margin;

an upper body section comprised of a left sleeve and a right sleeve connected by a rear section and a front section, the upper body section extending from the torso section upper margin to be retained between the stowage flap and the torso section and held in place about a wearer's body above the waist level, wherein the retention member is releasable to discharge the upper body section from between the stowage flap and the torso section such that the upper body section may assume a deployed position, in which it extends upwardly from the upper margin and the left sleeve and right sleeve fitted over the wearer's arms, wherein the upper body section has a front flap positioned frontwardly of the left sleeve and the right sleeve, and a back flap positioned rearwardly of the left sleeve and the right sleeve, a respirator mask connected to the front flap and having a rear periphery; and a hood connected to the back flap and having a front periphery, wherein the respirator mask rear periphery is engageable with the hood and is securable thereto to surround and enclose a wearer's head.

7. The hazard protection suit of claim 6 further comprising at least one head strap fastened on a left side of the hood and adjacent the hood front periphery and extending rearwardly to encircle the hood and to be fastened on a right side of the hood adjacent the hood front periphery.

8. The hazard protection suit of claim 6 further comprising a visor fastened to the hood rearwardly of the hood front periphery, the visor being movable between a first position in which the visor extends rearwardly above the hood, and a second position in which the visor is pivoted to extend frontwardly above the mask.

9. A hazard protection suit which forms a sealed interior space, the suit comprising:

a pants section;

an encircling tubular torso section extending upwardly from and connected to the pants section;

an upper body section comprised of a left sleeve and a right sleeve connected by a rear section and a front section, the upper body section extending from the torso section;

a storage flap connected to the torso section, wherein in a stowed position the storage flap extends over and retains the upper body section such that the upper body section is restrained between the storage flap and the torso section beneath the level of a wearer's arms, and wherein the storage flap may be released from a restraining position to allow the retained upper body section to be donned by a wearer to form the sealed interior space with the wearer within the sealed interior space;

a respirator mask connected to the front section and having a rear periphery; and a hood connected to the rear section and having a front periphery, wherein the respirator mask rear periphery is engageable with the hood and is securable thereto to surround and enclose a wearer's head.

10. The hazard protection suit of claim 9 wherein at least one zipper extends between the respirator mask and the hood to releasable engage the respirator mask rear periphery with the hood front periphery.

11. The hazard protection suit of claim 9 further comprising at least one head strap fastened on a left side of the hood and adjacent the hood front periphery and extending rearwardly to encircle the hood and to be fastened on a right side of the hood adjacent the hood front periphery.

12. A hazard protection suit comprising:

a pants section;

an encircling tubular torso section extending upwardly from the pants section;

an upper body section comprised of a left sleeve and a right sleeve connected by a rear section and a front section, the upper body section extending from the torso section a respirator mask connected to the front section and having a rear periphery; and a hood connected to the rear section and having a front periphery, wherein the respirator mask rear periphery is engageable with the hood and is securable thereto to surround and enclose a wearer's head; and a visor fastened to the hood rearwardly of the hood front periphery, the visor being movable between a first position in which the visor extends rearwardly above the hood, and a second position in which the visor is pivoted to extend frontwardly above the mask.

* * * * *